United States Patent [19]

Fargeaud et al.

[11] Patent Number: 5,021,006

[45] Date of Patent: Jun. 4, 1991

[54] CABLE CLAMP FOR ELECTRICAL CONNECTOR

[75] Inventors: Daniel Fargeaud, Dewitt, N.Y.; Gerard Tarrade, Limoges, France

[73] Assignee: Pass & Seymour, Inc., Syracuse, N.Y.

[21] Appl. No.: 548,677

[22] Filed: Jul. 5, 1990

[51] Int. Cl.[5] ..... H07R 13/595

[52] U.S. Cl. ..... 439/469

[58] Field of Search ..... 439/469, 472, 465–467

[56] References Cited

U.S. PATENT DOCUMENTS

| | | | |
|---|---|---|---|
| 2,091,054 | 8/1937 | Petrie | 439/472 |
| 2,480,895 | 9/1949 | Anderson | 439/472 |
| 2,686,828 | 8/1954 | Guy et al. | 439/472 |
| 3,390,369 | 6/1968 | Zavertnik et al. | 439/469 |
| 3,390,371 | 6/1967 | Kramer | 439/472 |
| 3,784,961 | 1/1974 | Gartland, Jr. | 439/465 |

*Primary Examiner*—Gary F. Paumen

*Attorney, Agent, or Firm*—Charles S. McGuire

[57] ABSTRACT

A strain-relief clamp for securely engaging a multi-conductor cable between two relatively movable pieces at a position closely adjacent the connections of the conductors to the terminals of an electrical plug, receptacle, or other wiring device. A first piece includes a hollow, cylindrical shell having an integrally formed, generally semi-cylindrical portion internally of the shell at one end, the wiring device being secured in the other end. A second piece is positioned inside the shell with an arcuate surface opposing an inwardly facing, curved surface of the semi-cylindrical portion of the first piece. A pair of screws pass through openings in the shell and semi-cylindrical portion of the first piece and are threadedly engaged in the second piece. A pair of flexible tabs or wings extend integrally from the second piece to contact the curved surface of the first, being positioned between the metal screws and the conductors to form a dielectric barrier as the screws are tightened to grip the cable tightly between the curved surfaces of the first and second pieces.

19 Claims, 2 Drawing Sheets

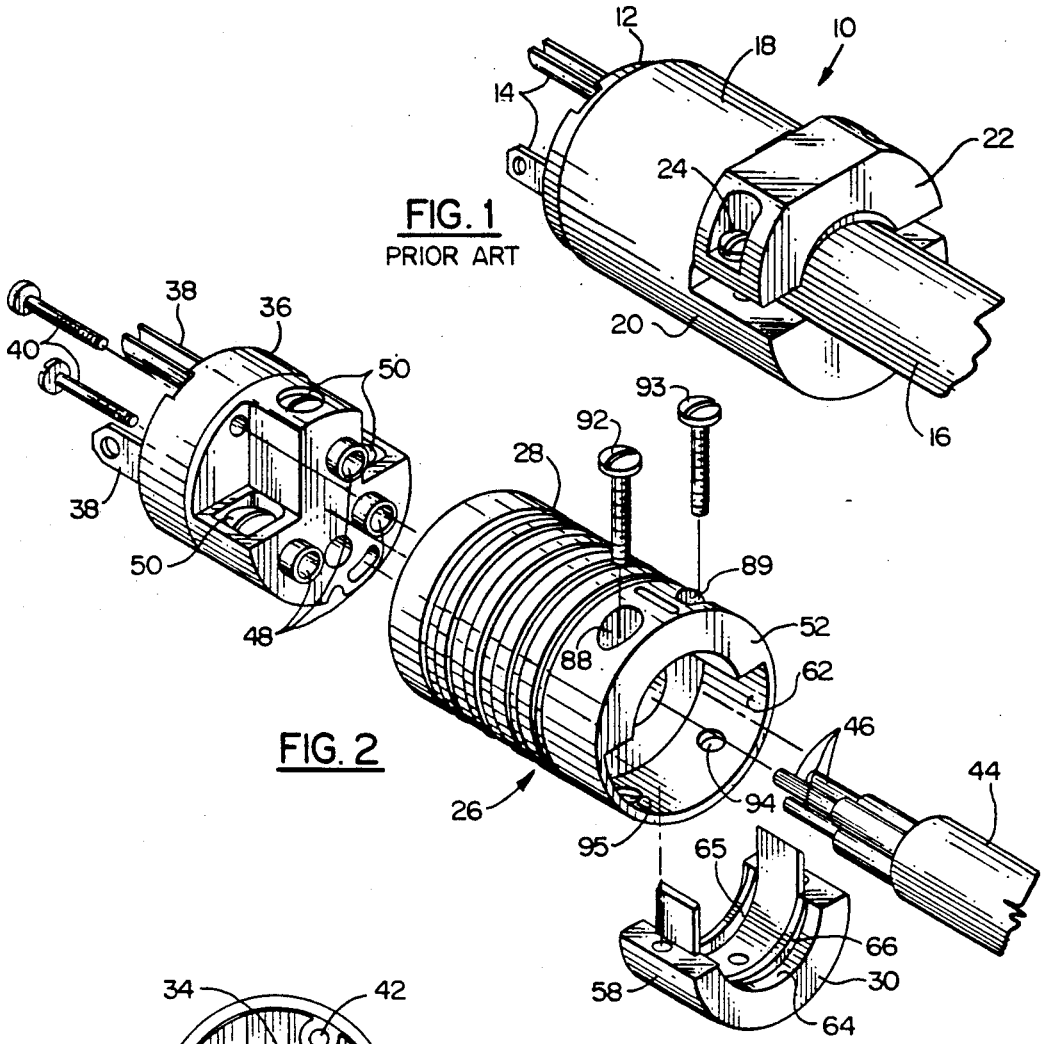
FIG. 1
PRIOR ART
FIG. 2
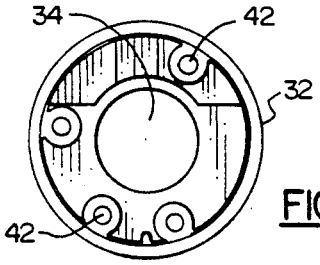
FIG. 3
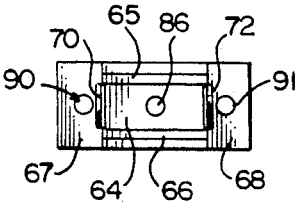
FIG. 5
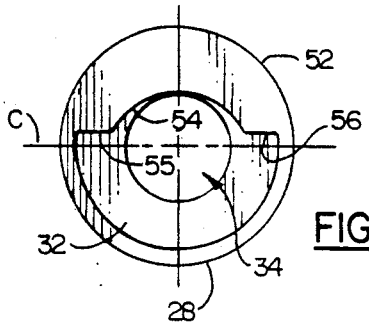
FIG. 4
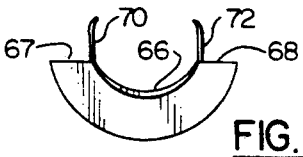
FIG. 6
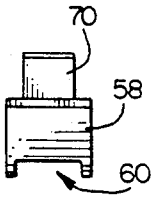
FIG. 8
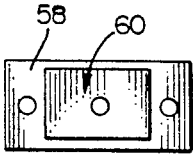
FIG. 7

CABLE CLAMP FOR ELECTRICAL CONNECTOR

BACKGROUND OF THE INVENTION

The present invention relates to electrical cord connectors of the type including means for securely clamping a multi-conductor cable at a position closely adjacent the connections of the individual conductors to the terminals of the connector.

Both male and female type connectors are commonly provided on the end of electrical cords and cables in such manner that twisting, tension, or other forces applied to the cable are not transmitted to the connections of the conductors with the terminals within the connector. That is, means are provided for firmly clamping the insulated cord or cable at a position within or closely adjacent the connector housing, such means being commonly termed strain-relief clamps or bushings. The strain-relief means of the prior art, as well as of the present invention, may be employed not only in male and female connectors, but in other wiring devices, such as cube taps, cord-mounted switches, electrical plugs and caps, and electrical connections in a panel or wiring box or appliance housing.

Among the types of structures used in strain-relief cable clamping are those embodied in a cylindrical housing with an opening through the center of one end for passage of the cord. At least two portions of the housing are movable relative to one another to permit insertion of the cord and clamping thereof between the relatively movable portions. The individual conductors are connected in electrically communicating relation with terminals of the wiring device which is inside, or otherwise fixed with respect to the housing.

In one popular form of such connector, a cylindrical housing is divided into two separate sections along both radial and axial lines. That is, one of the two pieces is formed as a full cylinder over a portion of its length, and in semi-cylindrical form over the remaining portion. The other piece is semi-cylindrical and mates with the semi-cylindrical portion of the first piece to complete the generally cylindrical configuration of the assembled housing. The two pieces are held in assembled relation by two screws passing, perpendicularly to and on opposite sides of the central axis of the housing, through openings in the semi-cylindrical piece into threaded or self-tapping openings in the semi-cylindrical portion of the other piece. The cable is positioned and clamped firmly between the two semi-cylindrical pieces.

One disadvantage of this configuration is that the smaller of the two housing pieces, i.e., the semi-cylindrical piece, is fully exposed on the exterior of the housing and, under some conditions, may tend to become loose or dislodged. This is sometimes exacerbated by the fact that the connector is expected to accommodate cables of different diameters and, when larger cables are used, the semi-cylindrical piece may protrude outwardly from the axially adjoining, cylindrical surface of the other piece. A second drawback is that there is no dielectric barrier between the metallic screws which hold the two housing pieces together and the conductors of the cable attached thereto, other than the insulation on the conductors, a portion of which is stripped away to permit connection of the conductors to the terminals within the connector. A third drawback is that when the attached cable is flexed axially, sufficient force can be applied to the clamping piece to cause it to move and create gaps and access to the terminal conductor connection.

It is a principal object of the present invention to provide an electrical connector having terminals for connection to individual conductors of a cylindrical cable with strain-relief cable clamping means embodied in a two-part housing of novel and improved design.

A further object is to provide a strain-relief cable connector including a two-part housing wherein a semi-cylindrical portion of the cable clamp is not exposed on the exterior of the housing.

Another object is to provide an electrical connector wherein a cylindrical cable is clamped between two, screw-connected pieces of housing incorporating means forming a dielectric barrier between the screw fasteners and the individual conductors of the cable.

Other objects will in part be obvious and will in part appear hereinafter.

SUMMARY OF THE INVENTION

In accordance with the foregoing objects, the invention contemplates a connector having a housing in the form of a cylindrical shell having an interior, radial wall with an opening surrounding the central axis of the cylinder. A wiring device such as a plug or receptacle is positioned within the shell on one side of the wall. On the other side, an integrally formed portion extends axially from the interior wall to the end of the shell and circumferentially for more than 90° and less than 180°. The integrally formed portion includes a curved surface facing the shell axis.

A second piece of the connector comprises an element having inner and outer, spaced, arcuate surfaces, an axial length not greater than that of the aforementioned integrally formed portion of the housing, and a circumferential extent greater than 90° and less than 180°. The second piece includes a pair of integrally formed, flexible tabs or wings, one extending from each side of the inner arcuate surface. The second piece is positioned within the cylindrical shell of the first piece, on the same side of the internal wall as the integrally formed portion with the curved surface of the latter facing the inner arcuate surface of the second piece.

A pair of openings extend through the cylindrical shell and integrally formed portion of the first piece, perpendicular to and on opposite sides of the central axis. Screws passing loosely through these openings are threadedly engaged in aligned openings in the second piece. The screws may pass entirely through the threaded openings in the second piece and into a further set of aligned openings in the shell. As the screws are tightened, the second piece is drawn toward the integrally formed portion of the first piece, firmly gripping the outer layer of insulation of a cylindrical, multi-conductor cable therebetween. The flexible wings extending from the second piece engage the inwardly facing, curved surface of the integrally formed portion, being positioned between the metallic screws and the cable, thereby providing a dielectric barrier on each side of the cable. Removable inserts may be placed in covering relation to either or both of the curved and inner arcuate surfaces to accommodate cables of different diameter.

The foregoing, and other features of the invention will be more readily understood and appreciated from the following detailed description, taken with the accompanying drawings, wherein:

BRIEF DESCRIPTION

FIG. 1 is a perspective view of a prior art cable clamp;

FIG. 2 is an exploded, perspective view of the cable clamp of the present invention;

FIGS. 3 and 4 are elevation views taken from opposite ends of a first piece of the cable clamp of FIG. 2;

FIGS. 5–8 are top, front, bottom and side elevational views, respectively, of a second piece of the clamp;

DETAILED DESCRIPTION

Figure 9:
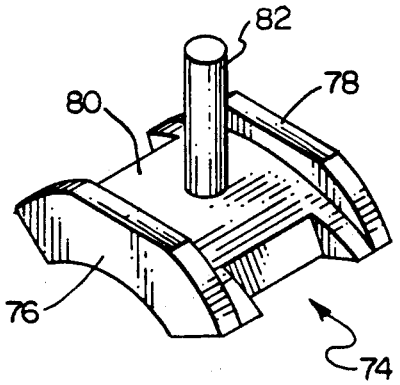
FIGS. 9 and 10 are perspective views of a removable insert of the clamp, taken from the upper and lower sides thereof.

Referring now to the drawings, in FIG. 1 is shown a typical, commercially available, prior art cable clamp of the same general type as the present invention, designated generally by reference numeral 10. Clamp 10 is designed to hold in one end a wiring device such as the illustrated male plug 12, having prongs 14 for insertion in a mating receptacle. The individual conductors of a multi-conductor cable 16 are electrically connected to terminals of plug 12 within cylindrical housing portion 18 of clamp 10. Extending from and integrally formed as one piece with housing portion 18 is semi-cylindrical portion 20, having a curved inner surface upon which a portion of cable 16 is positioned.

In addition to the first piece, comprising portions 18 and 20, clamp 10 includes a second, generally semi-cylindrical piece 22 which is affixed by a pair of screws 24 (only one of which is visible in FIG. 1) passing through openings in piece 22 and threadedly engaged in openings in portion 20 of the first piece. Piece 22 includes an inwardly facing, curved surface or a series of spaced, curved ridges for contacting cable 16. Thus, when the two pieces are assembled as shown and screws 24 are tightened, cable 16 is firmly clamped between the opposing, curved portions of the two pieces, thereby relieving any strain on the connections of the conductors to the terminals of plug 12. The two assembled pieces jointly form a generally cylindrical clamp housing, but piece 22 may protrude outwardly somewhat from the surface of portion 18. Also, there is no dielectric barrier between screws 24 and cable 16.

Turning now to FIGS. 2–8, the cable clamp of the present invention, denoted generally by reference numeral 26, includes a first piece in the form of a cylindrical shell 28, and a second, generally semi-cylindrical piece 30. Wall 32, having central opening 34, generally divides the interior of shell 28 into forward and rear portions, FIGS. 3 and 4 being views looking into the forward and rear portions, respectively. The forward portion is internally configured to receive a particular type of wiring device, here illustrated as a male plug having a body portion 36 with prongs 38 extending therefrom. Plug body 36 is secured within the forward portion of shell 28 by screws 40, which extend through openings in the plug body and are threadedly engaged in openings 42 within the shell.

Cable 44, including individual conductors 46 (line, neutral and ground), extends into the rear portion of shell 28 and through opening 34. Conductors 46, with the insulation stripped from end portions thereof, each extend into a respective one of openings 48 in plug body 36 and are secured therein by screws 50 in contact with terminals electrically communicating with prongs 38. In effecting such connections, cable 44 is pushed through the forward side of shell 28 to permit insertion of conductors 46 and tightening of screws 50 prior to placing plug body 36 into the forward end of shell 28 and installing screws 40.

Integrally formed with the first piece of clamp 26, within shell 28 and extending axially from the rear end thereof to wall 32, is generally semi-cylindrical portion 52. As may be noted from FIG. 4, portion 52 extends circumferentially about the axis of shell 28 for somewhat less than 180°; although the circumferential extent of portion 52 is not critical, it is preferred that it be less than 180° and greater than about 90°. As also seen in FIG. 4, curved surface 54 of portion 52 is tangent to opening 34 only at its midpoint, having a larger radius of curvature than the opening. End surfaces 55 and 56 of portion 52 lie in a plane parallel to and spaced from the horizontal centerline C of shell 28 in the position illustrated in FIG. 4.

Piece 30 includes outer, arcuate surface 58, having central recess 60, preferably of the same radius as inner surface 62 of shell 28, and inner, arcuate surface 64. Element 30 is configured for positioning in the rear portion of shell 28, with surface 62 in opposing relation to surface 54 of portion 52. Spaced ridges 65 and 66 extend inwardly from inner surface 64. The axial length of piece 30 is equal to or slightly less than that of portion 52, whereby piece 30 does not extend outside of shell 28 when positioned therein, and end surfaces 67 and 68 lie in a plane parallel to and spaced from end surfaces 55 and 56 of portion 52. Integrally formed wings 70 and 72 extend inwardly from piece 30 at the junctures of surface 64 with end surfaces 67 and 68, respectively.

Figure 10:
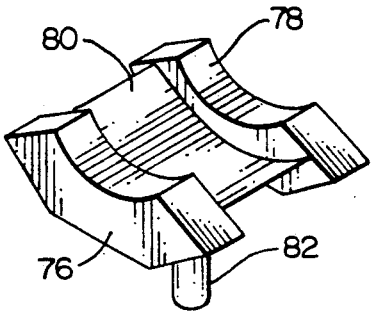

Optionally useable spacer element 72 is illustrated in FIGS. 9 and 10, comprising spaced, arcuate portions 76 and 78, integrally connected by medial portion 80. Stem 82 extends from a central position on the outer surface of portion 80 for removable insertion into either of openings 84 and 86 in portion 52 and piece 30, respectively.

Figure 11:
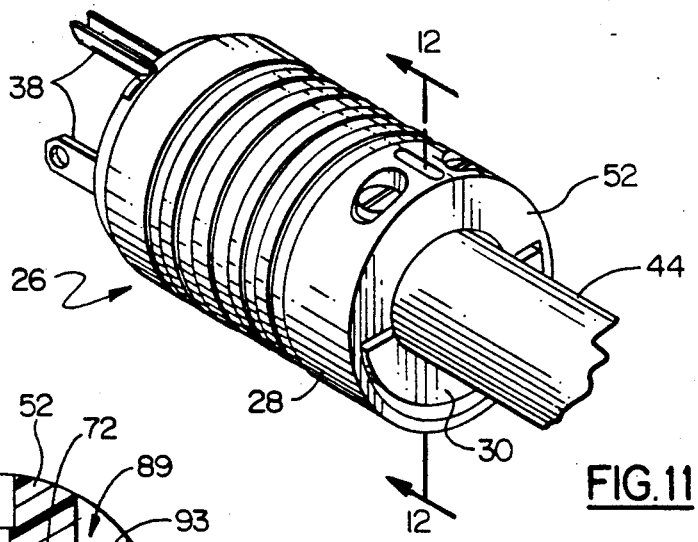
FIG. 11 is a perspective view of the clamp in fully assembled condition.
Figure 12:
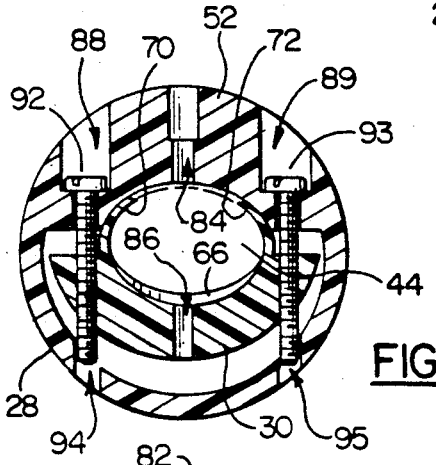
FIG. 12 is an end elevational view in section on the line 12—12 of FIG. 11.
Figure 14:
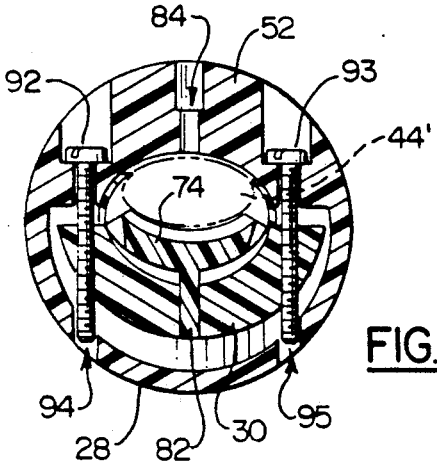
FIGS. 13 and 14 are sectional end views, as in FIG. 12, showing the removable insert in two different positions.
Figure 13:
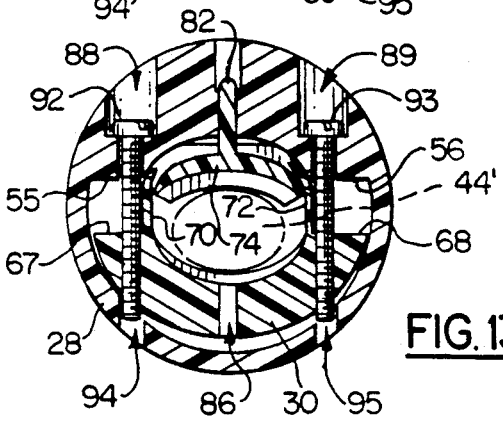

Clamp 26 is shown in FIG. 11, and the sectional views of FIGS. 12–14, in the fully assembled condition with cable 44 held firmly between the opposed, arcuate surface of portion 52 and piece 30. Piece 30 is placed within the rear portion of shell 28, in opposed relation to portion 52, thereby aligning a pair of openings 88 and 89 which extend through shell 28 and portion 52 with a pair of internally threaded openings 90 and 91 in piece 30. The enlarged, upper portions of openings 88 and 89 are large enough to accept the heads of screws 92 and 93, with the threaded portions of the screws passing freely through the smaller, lower portions of the openings, as seen in FIGS. 12–14. Screws 92 and 93 are threadedly engaged in tapped openings 90 and 91, respectively.

Cable 44 is inserted between the opposed surfaces of piece 30 and portion 52, which are loosely assembled, and through opening 34. After connection of conductors 46 to the wiring device associated with clamp 26 in the manner previously described, the device (plug 36) is positioned and affixed within the forward end of shell 28 by screws 40. Screws 92 and 93 are then tightened, thereby pulling piece 30 toward portion 52 and firmly engaging cable 44 therebetween. Depending on the length of screws 92 and 93, it may be desirable to provide a pair of openings 94 and 95 in the lower portion of shell 28 for loosely receiving the terminal ends of screws 92 and 93. That is, the screws may pass completely through threaded openings 90 and 91, and into slightly larger, untapped openings 94 and 95.

As cable 44 is squeezed between the opposing surfaces of piece 30 and portion 52, it is distorted from its original, circular cross section to a more elliptical shape, as seen in FIG. 12. Ridges 65 and 66 on piece 30 bite into the somewhat resilient insulation forming the outer covering of the cable, thus assisting in the gripping function and insuring that no strain is placed upon the connections of conductors 46 to the terminals of the wiring device. When a cable of smaller diameter than cable 44 is to be connected in the manner indicated, spacer 74 may be placed either in portion 52, with stem 82 extending into opening 84, as shown in FIG. 13, or in piece 30, with stem 82 extending into opening 86, as shown in FIG. 14, thereby facilitating the clamping of smaller diameter cable 44'.

In any case, the cable is held in a two-part, strain-relief cable clamp wherein the smaller, semi-cylindrical portion of the clamp is peripherally enclosed and thus cannot protrude beyond the symmetrical, cylindrical configuration of the housing. Furthermore, as screws 92 and 93 are tightened to pull piece 30 toward portion 52, the terminal ends of wings 70 and 72 contact curved surface 54 of portion 52 and are flexed inwardly. The wings extend across the space between end surfaces 55 and 56 of portion 52, and 67 and 68 of piece 30, providing a dielectric barrier between screws 92 and 93 and the cable engaged by the clamp.

What is claimed is:

1. A strain-relief electrical connector for a multi-conductor cable and associated wiring device, said connector comprising:

a) a first piece including:

i) a hollow, cylindrical shell having forward and rear sections separated by an internal wall having an opening therein concentric with the central axis of said shell and large enough for passage of said cable;

ii) means within said forward section for affixing said wiring device;

iii) a portion integrally formed as one piece with said shell within said rear section having a curved surface with an axis of curvature parallel to said central axis, said portion extending radially from said shell into said rear section by a distance not greater than the periphery of said opening, and extending from said wall for substantially the full axial extent of said rear section, and extending circumferentially for less than 180° and greater than about 90°; and iv) a first pair of openings extending through said rear section, including said shell and said portion, along spaced, parallel axes perpendicular to and on opposite sides of said central axis;

b) a second, generally semi-cylindrical piece having inner and outer arcuate surfaces and positioned within said cylindrical shell in said rear section of said shell with said inner arcuate surface opposing said curved surface to engage said cable therebetween, said second piece including a second pair of internally threaded openings respectively aligned with said first pair of openings; and c) a pair of screws respectively passing through said first pair of openings and threadedly engaged in said second pair of openings, whereby tightening said screws pulls said second piece toward said portion of said first piece to firmly engage said cable between said curved surface of said portion of said first piece and said inner arcuate surface of said second piece.

2. The electrical connector of claim 1 wherein said portion includes two, planar, first end surfaces extending between opposite ends of said curved surface and the inside of said shell.

3. The electrical connector of claim 2 wherein said second piece includes two, planar, second end surfaces respectively extending between opposite ends of said inner and outer arcuate surfaces, said first and second end surfaces lying in respective, parallel planes spaced from one another on opposite sides of a transverse centerline of said shell.

4. The electrical connector of claim 3 wherein said first and second pairs of openings respectively extend through said first and second end surfaces.

5. The electrical connector of claim 4 and further including a pair of spaced, arcuate ridges extending inwardly toward said central axis from at least one of said curved and said inner arcuate surfaces, extending transversely thereof to engage an outer, insulating cover of said cable as said screws are tightened.

6. The electrical connector of claim 4 and further including at least one spacer element removably positioned in covering relation to at least one of said curved and said inner arcuate surface, thereby adapting said connector for use with smaller diameter cables.

7. A strain-relief clamp for firmly engaging a multi-conductor electrical cable at a position closely adjacent connection of said conductors with respective terminals of a wiring device fixedly positioned with respect to said clamp, comprising:

a) a first piece of dielectric material having a first, curved, inner surface;

b) a second piece of dielectric material having a second, curved inner surface and positioned in spaced relation to said first piece with said first and second curved surfaces facing one another on opposite sides of an axis along which said cable extends;

c) a pair of flexible, relatively flat wings extending integrally from one of said pieces toward the other of said pieces, said wings being positioned on laterally opposite sides of said cable; and d) metallic fastening means operable to move said first and second pieces toward one another, thereby firmly engaging said cable therebetween, said fastening means positioned outwardly of said wings, whereby said wings are positioned between said metallic fastening means and said cable to provide a dielectric barrier.

8. The clamp of claim 7 wherein said fastening means comprises a pair of screws.

9. The clamp of claim 8 wherein said wings extend from said second piece toward said first piece and said screws extend through a first pair of openings in said first piece and are threadedly engaged in a second pair of openings in said second piece.

10. The clamp of claim 9 wherein said first curved surface extends laterally between first and second terminal ends, bounded by first and second planar end surfaces, respectively.

11. The clamp of claim 10 wherein said wings include terminal ends separated by a distance not greater than the lateral extent of said first curved surface, whereby said terminal ends contact said first curved surface as said first and second pieces are moved toward one another.

12. The clamp of claim 11 wherein said second curved surface extends laterally between third and fourth terminal ends, bounded by third and fourth planar end surfaces, respectively.

13. The clamp of claim 12 wherein said planar end surfaces bounding said first and second curved surfaces lie in respective first and second planes, parallel to one another and to said axis.

14. The clamp of claim 13 wherein said first and second pairs of openings are all formed in said end surfaces.

15. The clamp of claim 14 wherein the lateral extents of said first and second curved surfaces are substantially equal.

16. A two-piece, strain-relief clamp for a generally cylindrical, multi-conductor cable to firmly engage outer surface portions of said cable at a position closely adjacent a wiring device fixed with respect to said clamp to which said conductors are connected, said clamp comprising:

a) a first piece comprising:

i) a cylindrical, outer shell having first and second ends lying in planes normal to a central axis;

ii) a generally semi-cylindrical portion formed integrally with and internally of said shell and having a first, arcuate, inner surface curved about a first axis parallel to said central axis; and iii) a first pair of openings parallel to one another, and perpendicular to and on opposite sides of said central axis extending through both said shell and said first portion;

b) a second piece having a second, arcuate, inner surface and positioned entirely within said shell with said second surface facing said first surface and curved about a second axis parallel to said first and central axes;

c) a second pair of openings extending into said second piece in respective alignment with said first pair of openings, whereby a pair of screws inserted through said first pair of openings and threadedly engaged in said second openings operate to move said second piece toward said semi-cylindrical portion as said screws are tightened to firmly engage said cable between said first and second arcuate surfaces and d) a pair of flexible, relatively flat wings extending integrally from one of said semi-cylindrical portion and said second piece into contact with the other, said wings being positioned between laterally opposite sides of said cable and respective screws inserted through said first pair and into said second pair of openings.

17. The clamp of claim 16 wherein said wings are integrally formed with said second piece.

18. The clamp of claim 17 wherein said wings extend from said second piece to contact said first surface, being flexed inwardly as said second piece is moved toward said semi-cylindrical portion.

19. The clamp of claim 16 wherein said second pair of openings extend entirely through said second piece, and further including a third pair of openings extending through said outer shell in respective alignment with said first and second pairs of openings, whereby the terminal ends of screws passing through said first and second pairs of openings may be received in said third pair of openings.

* * * * *